US007392769B2

(12) United States Patent
Heldberg

(10) Patent No.: US 7,392,769 B2
(45) Date of Patent: Jul. 1, 2008

(54) COOLING SYSTEM FOR A COMBUSTION ENGINE

(75) Inventor: Carsten Heldberg, Kirchlinteln-Ostersen (DE)

(73) Assignee: ITW Automotive Products GmbH & Co. KG, Iserlohn (DE)

( * ) Notice: Subject to any disclaimer, the term of this patent is extended or adjusted under 35 U.S.C. 154(b) by 110 days.

(21) Appl. No.: 11/537,358

(22) Filed: Sep. 29, 2006

(65) Prior Publication Data

US 2007/0079774 A1 Apr. 12, 2007

(30) Foreign Application Priority Data

Oct. 8, 2005 (DE) ..... 10 2005 048 286

(51) Int. Cl.
*F01P 7/14* (2006.01)

(52) U.S. Cl. ..... 123/41.1; 123/41.29

(58) Field of Classification Search ..... 123/41.1, 123/41.29

See application file for complete search history.

(56) References Cited

U.S. PATENT DOCUMENTS

| | | | | |
|---|---|---|---|---|
| 3,851,629 | A * | 12/1974 | Mayr et al. | 123/41.08 |
| 7,069,880 | B2 * | 7/2006 | Hutchins | 123/41.29 |
| 7,207,298 | B2 * | 4/2007 | Lee | 123/41.29 |
| 2002/0069839 | A1 * | 6/2002 | Kunze et al. | 123/41.1 |

FOREIGN PATENT DOCUMENTS

| | | | |
|---|---|---|---|
| DE | 23 20 447 | A | 11/1974 |
| DE | 3608294 | A1 * | 9/1987 |
| DE | 4131357 | C1 * | 7/1992 |
| DE | 102 06 359 | A | 9/2003 |
| GB | 2 401 166 | A | 11/2004 |
| WO | 2004/022941 | A | 3/2004 |

* cited by examiner

*Primary Examiner*—Noah Kamen
(74) *Attorney, Agent, or Firm*—Lowe, Hauptman, Ham & Berner, LLP

(57) ABSTRACT

A cooling system for a combustion engine having a cooling passage system in an engine block comprising a main cooler HWK which is arranged in a cycle with the cooling passage system of the combustion engine, a water pump and a first thermostat TH1 in said cycle, a hot water heat exchanger HWT which is connected to the water pump 12 through a bypass and a bypass valve, a second thermostat TH2 in the bypass passage, the opening temperature of the thermostat valve of the second thermostat TH2 is significantly lower than the opening temperature of the thermostat valve of the first thermostat TH1, the thermostats being arranged such that upon closed thermostat valve B of the second thermostat TH2 below its opening temperature a minimum amount of water flows through the cooling passage system through the heat exchanger HWT, upon opened thermostat valve B of the second thermostat TH2 a larger amount of water flows through the cooling passage system from its opening temperature on and upon the opening temperature of the thermostat valve A of the first thermostat TH1 a thermostatic control takes place through the first thermostat TH1 and the main cooler HWK whereby the amount of cooling fluid is progressively increased from the opening of the thermostat valve B of the second thermostat TH2 on and/or least a further heat exchanger MÖK, GÖK is connected.

16 Claims, 9 Drawing Sheets

COOLING SYSTEM FOR A COMBUSTION ENGINE

RELATED APPLICATIONS

The present application is based on, and claims priority from, German Application Number 10 2005 048 286.4, filed Oct. 8, 2005, the disclosure of which is hereby incorporated by reference herein in its entirety.

BACKGROUND OF THE INVENTION

The present invention is related to a cooling system for a combustion engine.

In the context of regulations for exhaust gas and consumption, it is necessary to achieve rapid warming up of the combustion engine to its working temperature, in automobiles in particular, because a big part of the relevant emissions and of the consumption is created in the cold operation. The rapid warming is obtained when the amount of cooling fluid circulating through the engine in the cold start is reduced to a minimum degree. However, it has to be taken care with respect to the operational safety that the amount of cooling fluid is sufficient to securely prevent local overheating on critical points of the engine. In addition, legal rules for the defrosting of the glazing at cold outside temperatures must be fulfilled.

In cooling systems for combustion engines, it is distinguished between engine blocks which have only one cycle and such ones which have separate cooling of the head and the block. In the latter case, the water jacket of the engine has two cycles.

Conventionally, one thermostat is provided in single-cycle cooling systems, which is realised as a double valve. Below the working temperature, cooling fluid is conveyed through the cooling passage system of the engine via a heat exchanger for heating (for heating the passenger compartment), the second valve of the thermostat and a bypass. When the working temperature is reached, the thermostat opens and by doing so it throttles the flow across the heat exchanger for heating by the second valve, whereas the main part of the cooling fluid is led through a main cooler.

SUMMARY OF INVENTION

The present invention is based on the objective to provide a cooling system for a combustion engine by which a very rapid heating up of the engine can be achieved.

In the cooling system according to the present invention, a second thermostat valve is arranged in the bypass branch, which has an opening temperature which is significantly lower than the opening temperature of the first thermostat valve. The two thermostat valves are arranged such that upon closed second thermostat valve, a minimum amount of water flows through the cooling passage system of the engine below its opening temperature, which makes it possible that the engine is heated up in a very short time. In doing so, the circulating amount of cooling fluid flows through the heat exchanger for heating. After the opening temperature of the second thermostat valve is reached, cooling fluid flows through the system in a larger amount, by forming a bypass to the heat exchanger for heating, for instance. After the opening temperature of the first thermostat valve is reached, the cooling fluid flows through the main cooler, the first thermostat valve providing control of the cooling fluid temperature in doing so, as is per se known. With increasing temperature, the amount of cooling fluid flowing through the bypass is progressively throttled.

In the present invention, minimizing the cooling fluid which circulates through the engine at cold start is achieved by using a thermostat with low opening temperature, wherein this thermostat permits a continuous increase of the flow of cooling fluid through the engine and an additional connection of additional heat exchangers at option conforming to demand, like an engine oil cooler or a gear oil cooler.

The thermostat valves may be arranged in a common casing or separately.

Preferably, the thermostat valves are realised as double valves with a second valve each, such that the same is opened upon closed thermostat valve and reduces its effective area with increasing opening of the thermostat valve. Preferably, according to one embodiment of the invention, the second valve of the first thermostat valve is completely closed when the first thermostat valve is completely opened. With respect to the second thermostat valve, one embodiment provides that the second valve is in a throttling position when the second thermostat valve is completely opened.

Depending on which control is preferred, namely either an engine outlet control or a water pump inlet control, the connection of the first thermostat and in connection therewith also of the second thermostat takes place. In the first case, the advantage is obtained that tubes and the main cooler are relieved from the cooling system pressure at the cold start. The latter configuration permits good control behaviour.

Depending on the configuration, the system according to the present invention makes the additional connection of at least one additional heat exchanger possible, like an engine oil or gear oil cooler, for instance. This additional heat exchanger is connected with the cooling system according to the present invention such that cooling fluid flows through it either below the opening temperature of the second thermostat valve or from the opening temperature of the second thermostat valve on or from the opening temperature of the first thermostat valve on.

The cooling system according to the present invention can also be applied to separate cooling systems for the engine block and the cylinder head, wherein one thermostat is assigned to each cooling system, as is usual. In the solution according to the present invention, a third thermostat is assigned to the cooling system for the engine block, the two thermostats for the cooling system of the engine block working and being connected in that manner as has been described in connection with one single cooling circuit.

In the following, the present invention will be explained in more detail by means of drawings.

DETAILED DESCRIPTION OF THE EMBODIMENTS

The cooling system for a combustion engine represented in FIGS. 1-9 has always the same components and assembly parts. The combustion engine is indicated as "MOTOR". The engine block has a not shown cooling passage system, a bypass passage 10 being assigned to the engine block. A water pump 12 serves for the circulation of cooling water through the cooling passage system of the engine. To the cooling system belongs a heat exchanger EGR for recycled exhaust gas, an engine oil cooler MÖK, a gear oil cooler GÖK, a heat exchanger for heating HWT, a main water cooler HWK, a first thermostat TH1 and a second thermostat TH2.

The thermostats TH1 and TH2 are realised as double valves with a thermostat valve A or B, respectively, and a second valve a or b, respectively, which are jointly shifted through an expansion wax element, but work in opposite senses, with which will be dealt again below.

The thermostat valve A opens at about 87° C., which is commonly the opening temperature for cooling water thermostats. On the other hand, the thermostat valve B opens at a significantly lower temperature, of 30-35° C., for instance.

In the embodiment according FIGS. 6-9, a water pump inlet control is provided, i.e. the thermostat TH1 is assigned to the inlet of the water pump 12. At the outlet of the cooling passage system of the engine, there is the second thermostat TH2, the unhindered passage of which is connected with the main water cooler via a channel. The outlet of the latter is connected with the thermostat TH1. The inlet of the heat exchanger for heating HWT is connected with the thermostat TH2 and its outlet with the bypass 10. The thermostats TH1 and TH2 are connected with each other. The oil coolers MÖK and GÖK are connected with the inlet of the thermostat TH1 via a line. The first thermostat TH1 is connected with the inlet of the water pump 12, as has been mentioned already.

Figure 6:
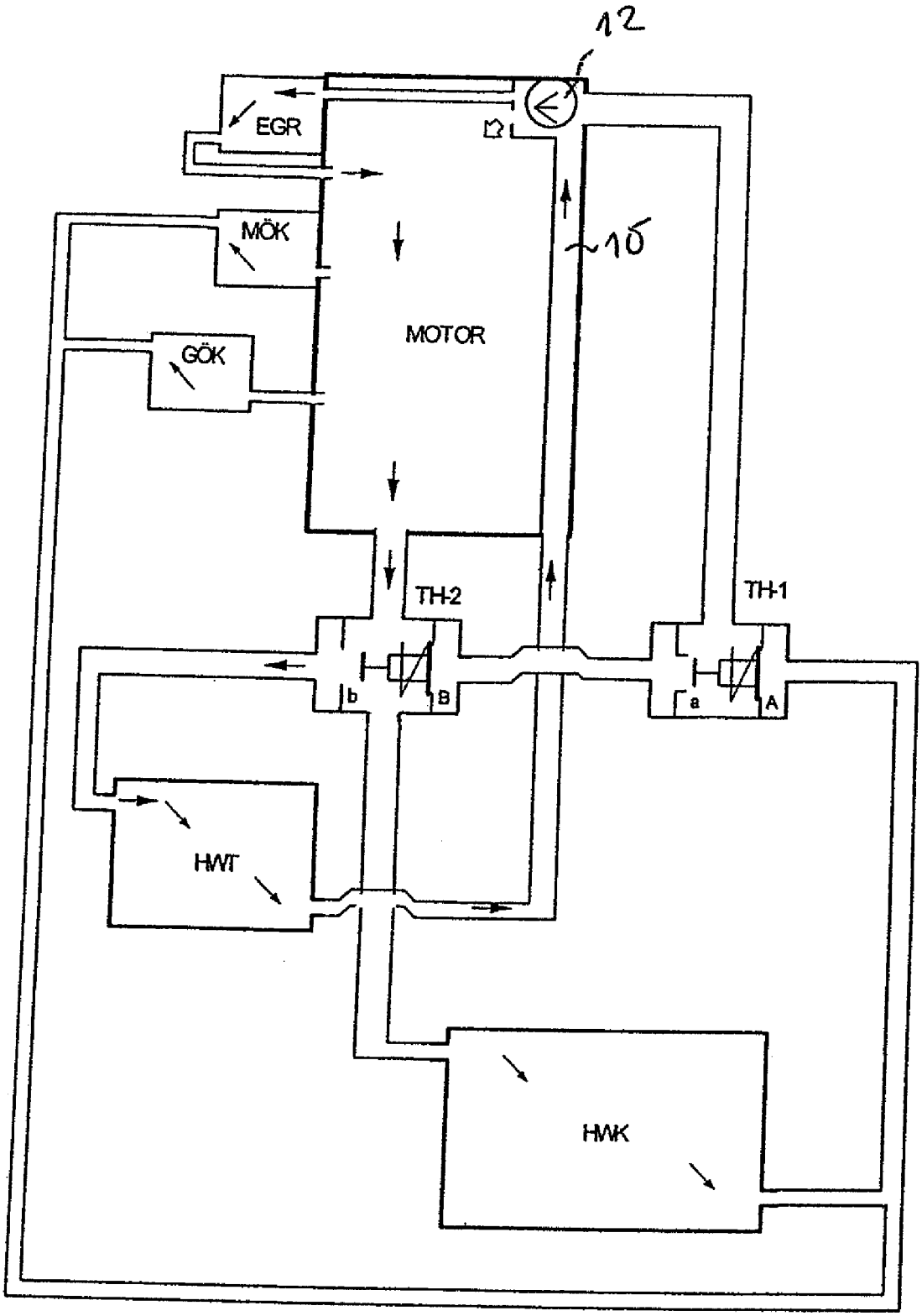
FIGS. 6-9 show a further embodiment of a connection arrangement for a cooling system according to the present invention in different conditions.
Figure 7:
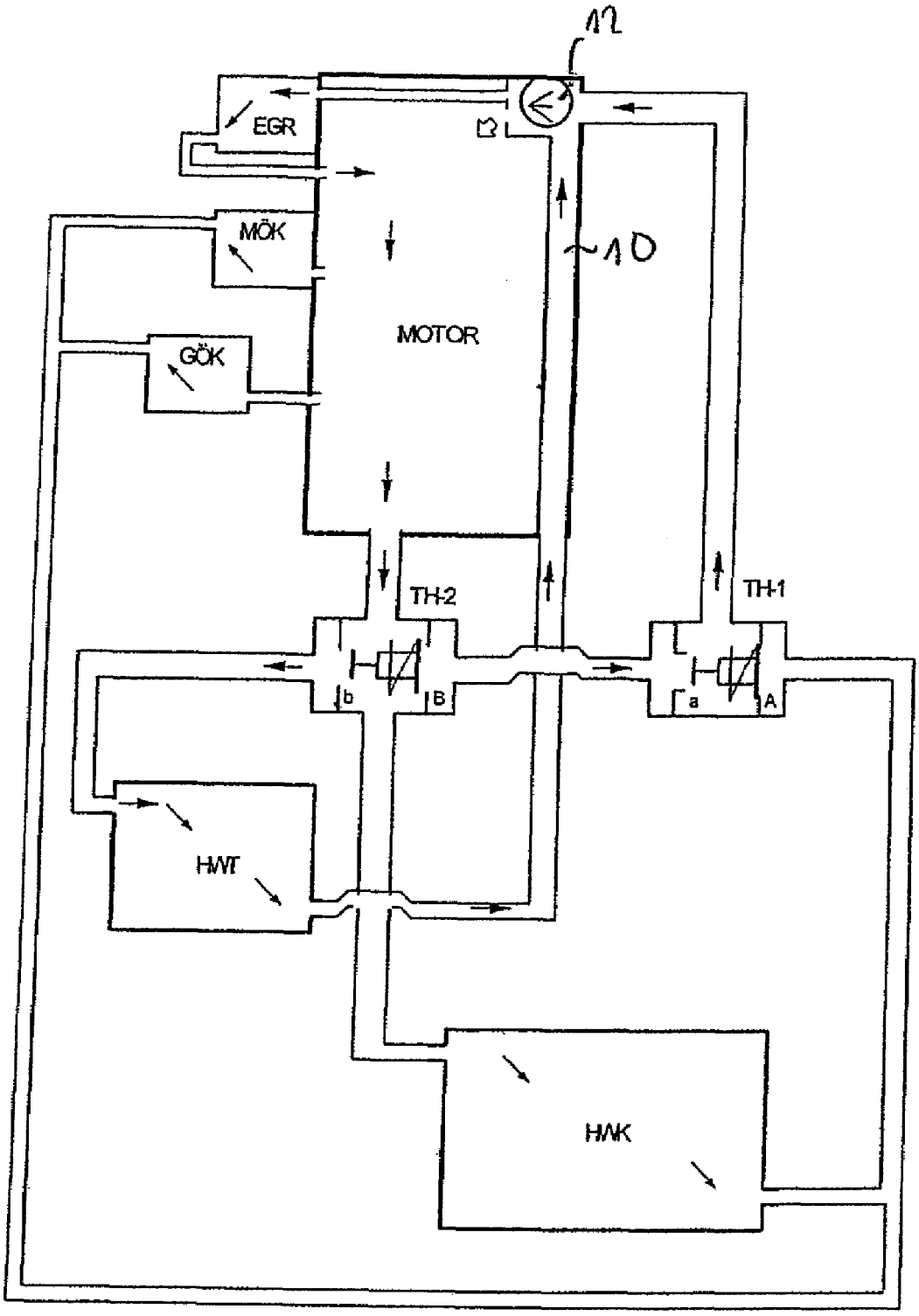
Figure 8:
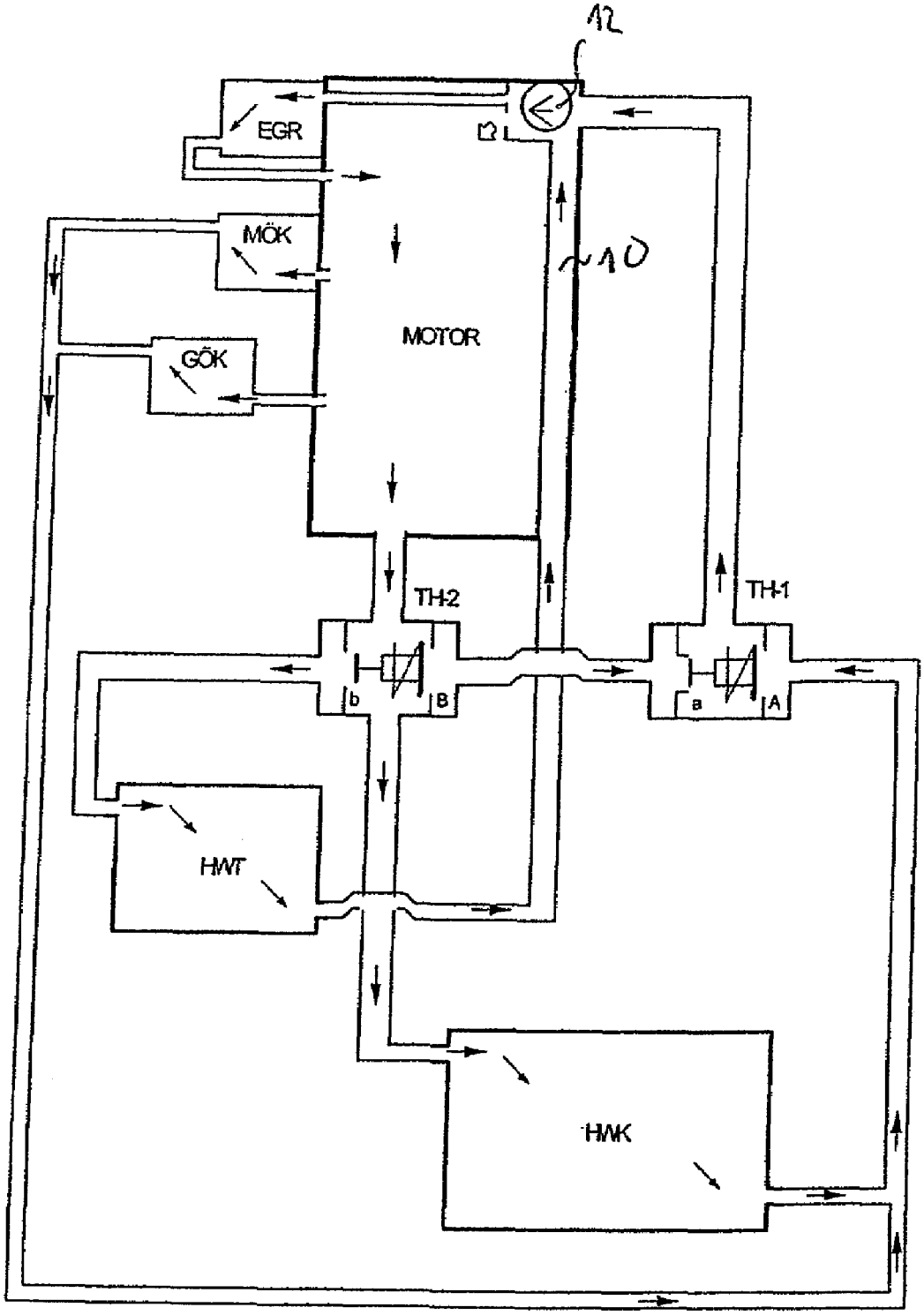

In FIG. 6, the cooling system is represented in a condition which coffesponds to the so-called cold start. The water pump 12 conveys a minimal amount of water via the second valve b of the second thermostat TH2, the heat exchanger for heating HWT and the bypass 10 through the cooling passage system of the engine. It should be mentioned for the sake of completeness only that the heat exchanger for heating serves for heating the passenger compartment of the automobile. As both thermostat valves A and B are closed, cooling fluid does not flow through the oil coolers MÖK and GÖK, or through the main water cooler HWK. After the opening temperature of 30-35° C., e.g., of the thermostat valve B is reached, the latter permits passage of water to the first thermostat TH1 too, via the described connection line and the second valve a, so that an additional amount of cooling fluid flows through the cooling passage system of the engine. The proportion thereof increases with increasing opening area of the thermostat valve B. The described process is indicated in FIG. 7. When—as indicated in FIG. 8—the opening temperature of the first thermostat TH1 is reached, 87° C. e.g., the thermostat valve A opens, so that water flows through the main water cooler HWK and an additional amount of cooling fluid flows through the cooling passage system. At the same time, the amount of water flowing through the heat exchanger for heating HWT is limited by the progressive closing of the second valve a. At the same time, the short circuit between the thermostats TH1 and TH2 is throttled down by gradual closing of the second valve b. In addition, the water path through the oil coolers MÖK and GÖK is now opened up. The cooling system is now in the regular operation.

Figure 9:
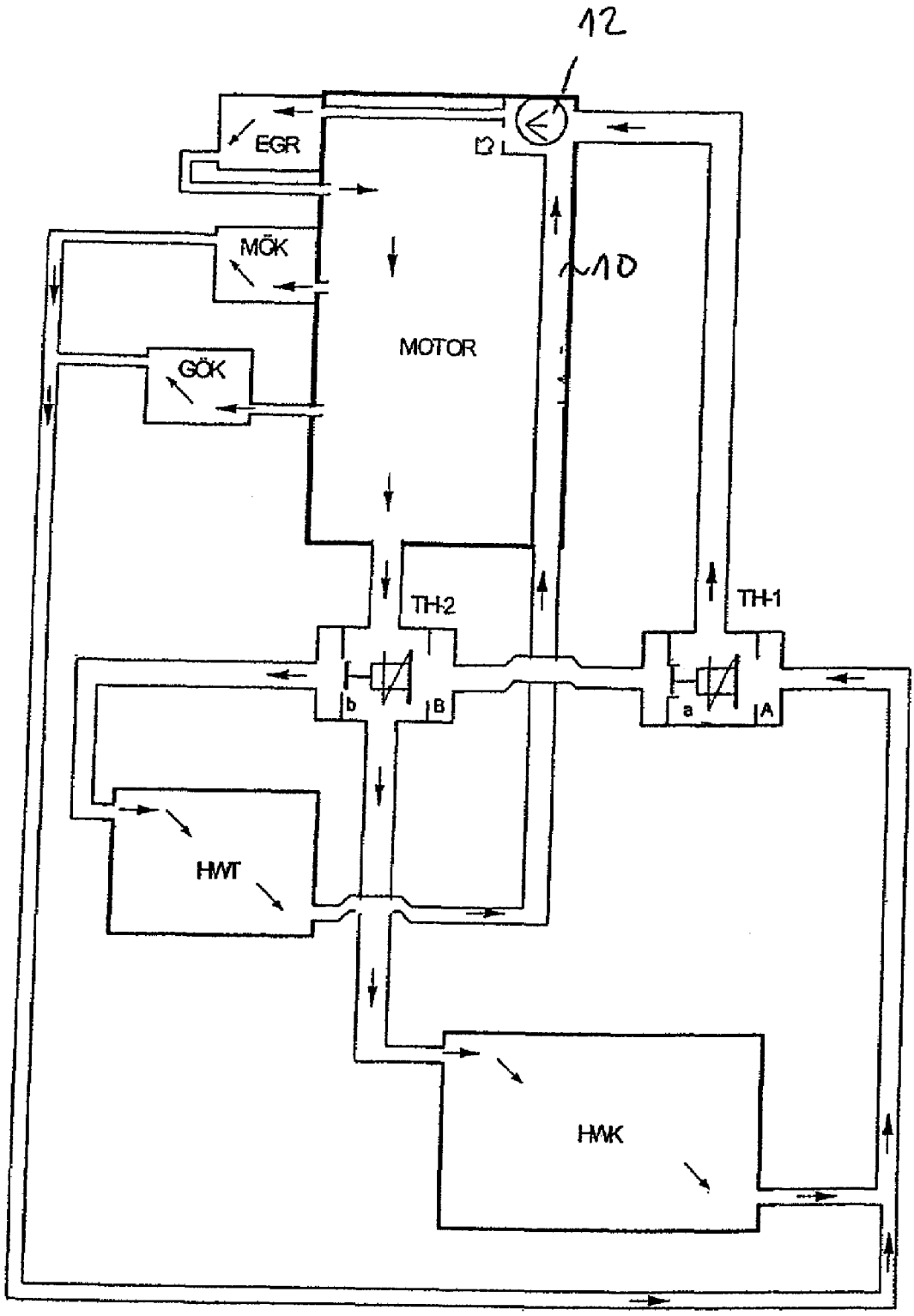

In the case that the temperature of the water rises further, the thermostat valve A is completely opened according to FIG. 9, and the second valve a is completely closed. The second valve b of the thermostat TH2 reaches a big throttling rate. In this, a maximum amount of water is led through the main water cooler HWK.

In the embodiments of the represented cooling system according to FIG. 1 to 5, only the cold start phase is indicated in each case.

Figure 1:
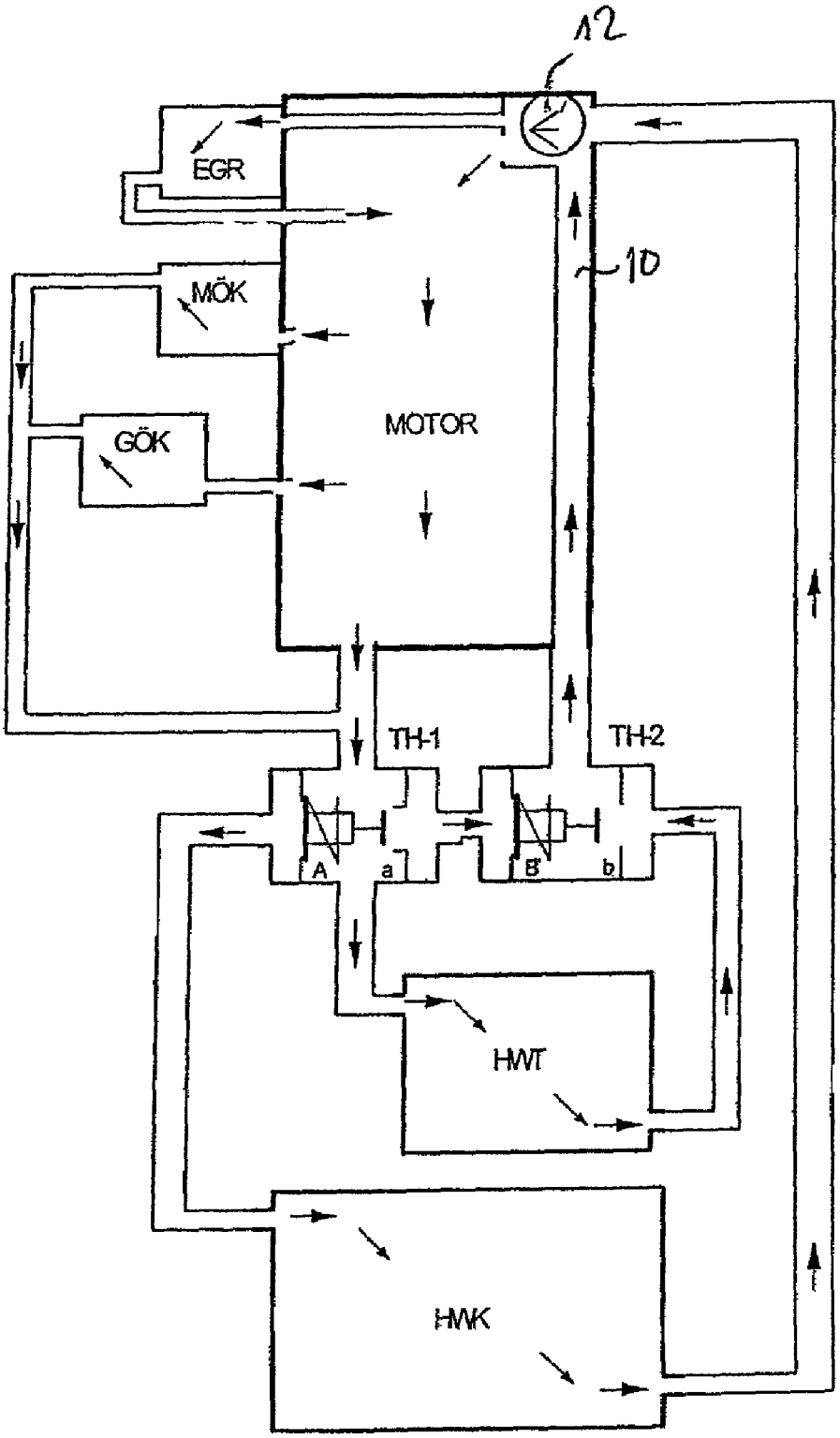
FIGS. 1-5 schematically show connection arrangements for a cooling system, in different configurations.

In the embodiment according to FIG. 1, an engine outlet control is used, by which the tubes and the main water cooler HWK, for instance, are relieved from the cooling system pressure at the cold start. During the cold start, water flows through the whole heat exchanger for heating HWT, the cooling fluid flowing back to the water pump 12 being led inside the bypass 10, which is located in the engine block. At the same time, cooling fluid flows through the oil coolers MÖK and GÖK. This embodiment of a cooling system connection makes sense particularly when the oil is to be rapidly heated up in order to minimize frictional losses.

After reaching the opening temperature of the thermostat TH2, an additional bypass path is opened via the second valve a and the thermostat valve B. This increases the amount of water circulating in the engine and prevents local overheatings. The use of the additional amount of water takes place smoothly. The thermostat TH2 is dimensioned such that throttling of the water from the heat exchanger for heating HWT by the valve b takes place only when the temperature of the water is higher than 90° C., for instance. The valve b never closes completely.

After reaching the opening temperature of the thermostat TH1, the thermostat valve A begins to open slowly and the second valve b begins to close. In doing so, the water is led through the main water cooler HWK, and at the same time, the additional water path via the bypass is throttled. In the hot operation, the water path via the main water cooler is completely opened and the bypass path is completely closed. At the same time, the water circuit via the heat exchanger for heating HTW is strongly throttled. This prevents any overheating of the passenger compartment and makes it possible to lead an amount as big as possible via the main water cooler HWK.

Figure 2:
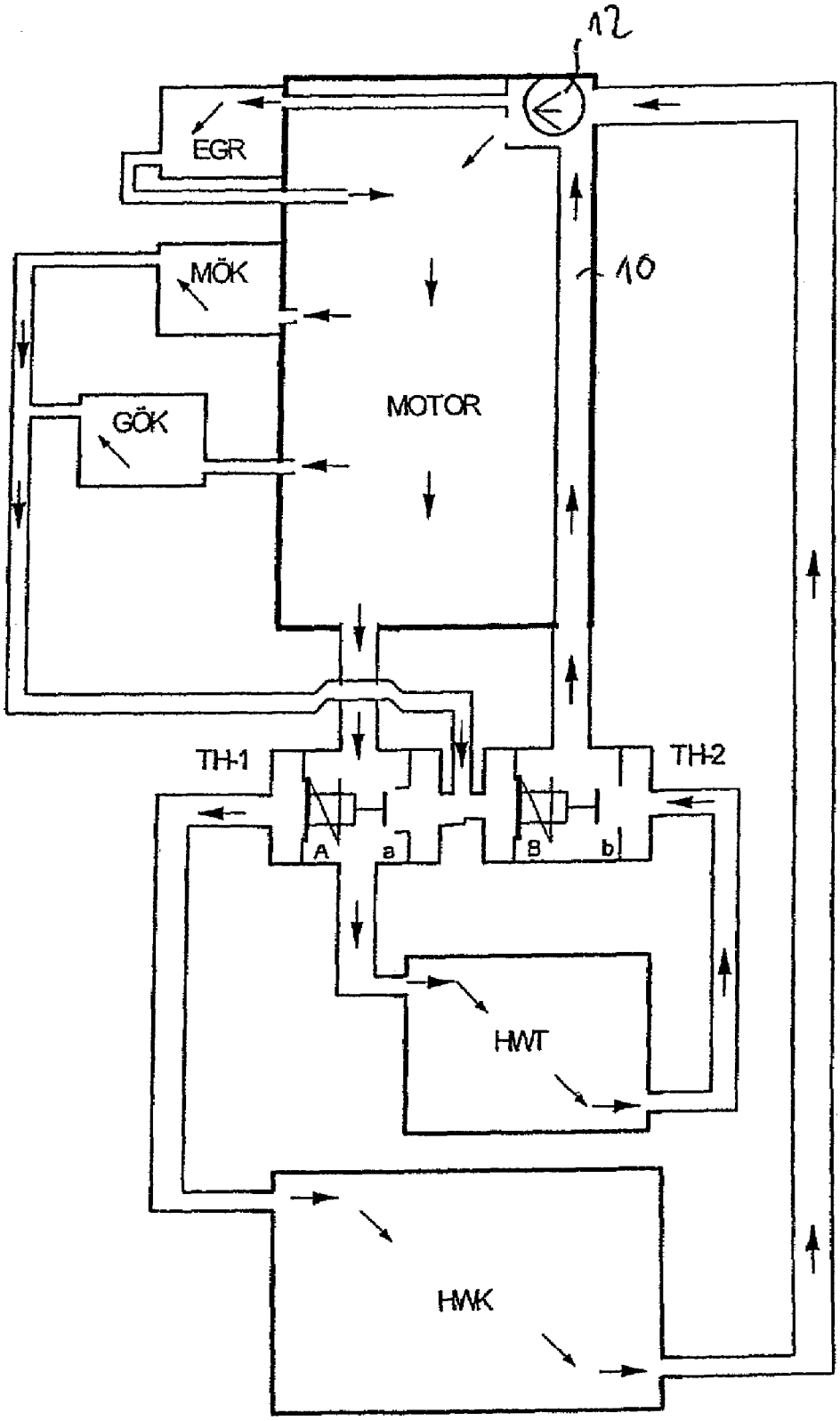

The embodiment according to FIG. 2 is different from that according to FIG. 1 only in the way of the linking of the oil coolers GÖK and MÖK. Through the linking between the thermostats TH1 and TH2, more cooling fluid is led through these heat exchangers from the start of the opening the thermostat valve B on.

Figure 3:
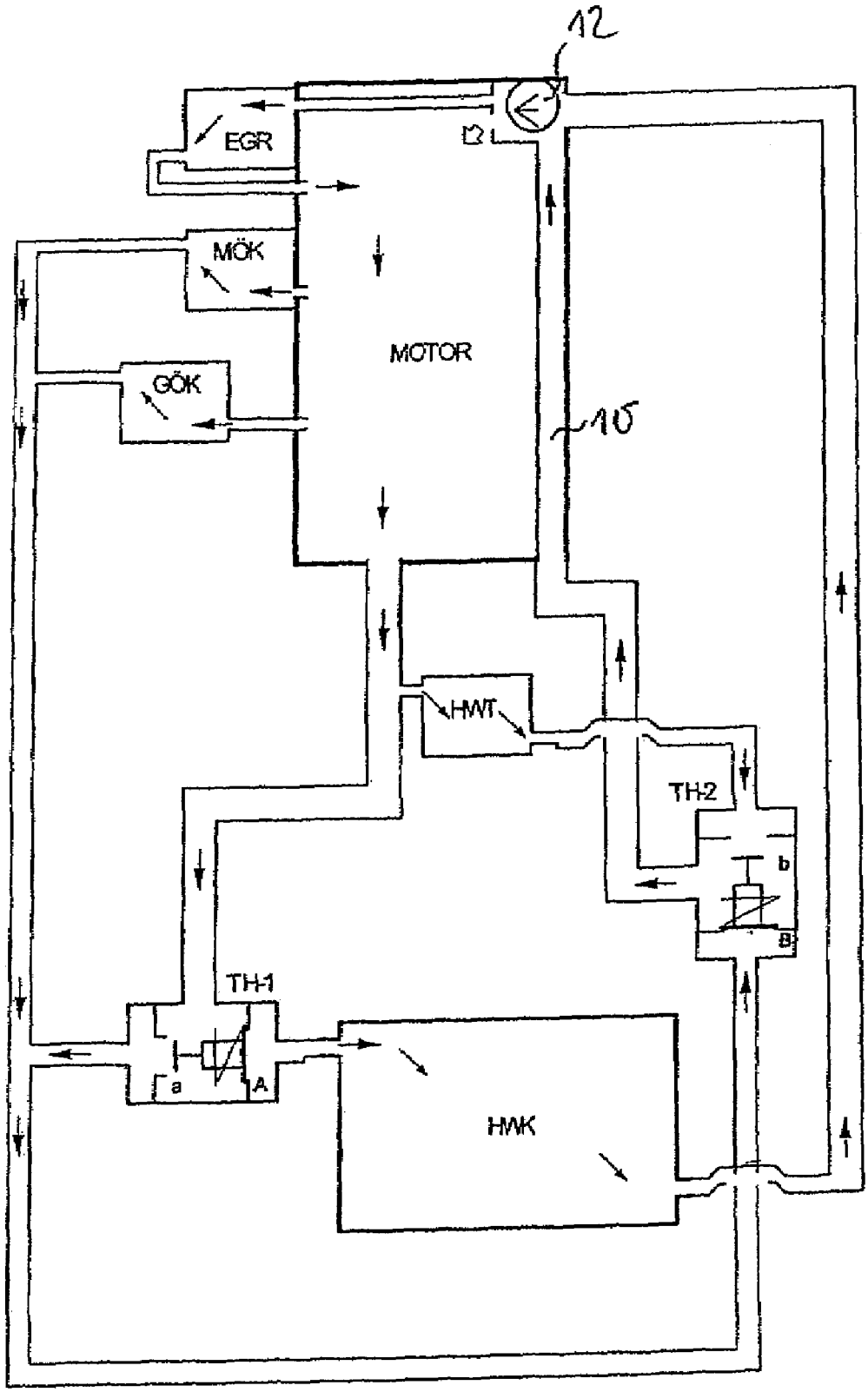

FIG. 3 shows a motor outlet control, like FIGS. 1 and 2, i.e. the first thermostat TH1 is assigned to the outlet of the cooling passage system of the engine. In the cold start phase, the water flows to the water pump 12 via the heat exchanger for heating HWT and the valve b of the second thermostat TH2 and the bypass 10. In addition, water from the oil coolers MÖK and GÖK can also flow through the heat exchanger for heating HWT via the valve a of the first thermostat TH1. After the opening of the second thermostat TH2, the water flows back through the same immediately to the engine. During the cold start as well as after the opening of the second thermostat TH2, the water stream coming from the cooling passage system of the engine is divided, wherein a part flows through the heat exchanger for heating HWT and an other part through the first thermostat TH1, i.e. through its second valve a.

Figure 4:
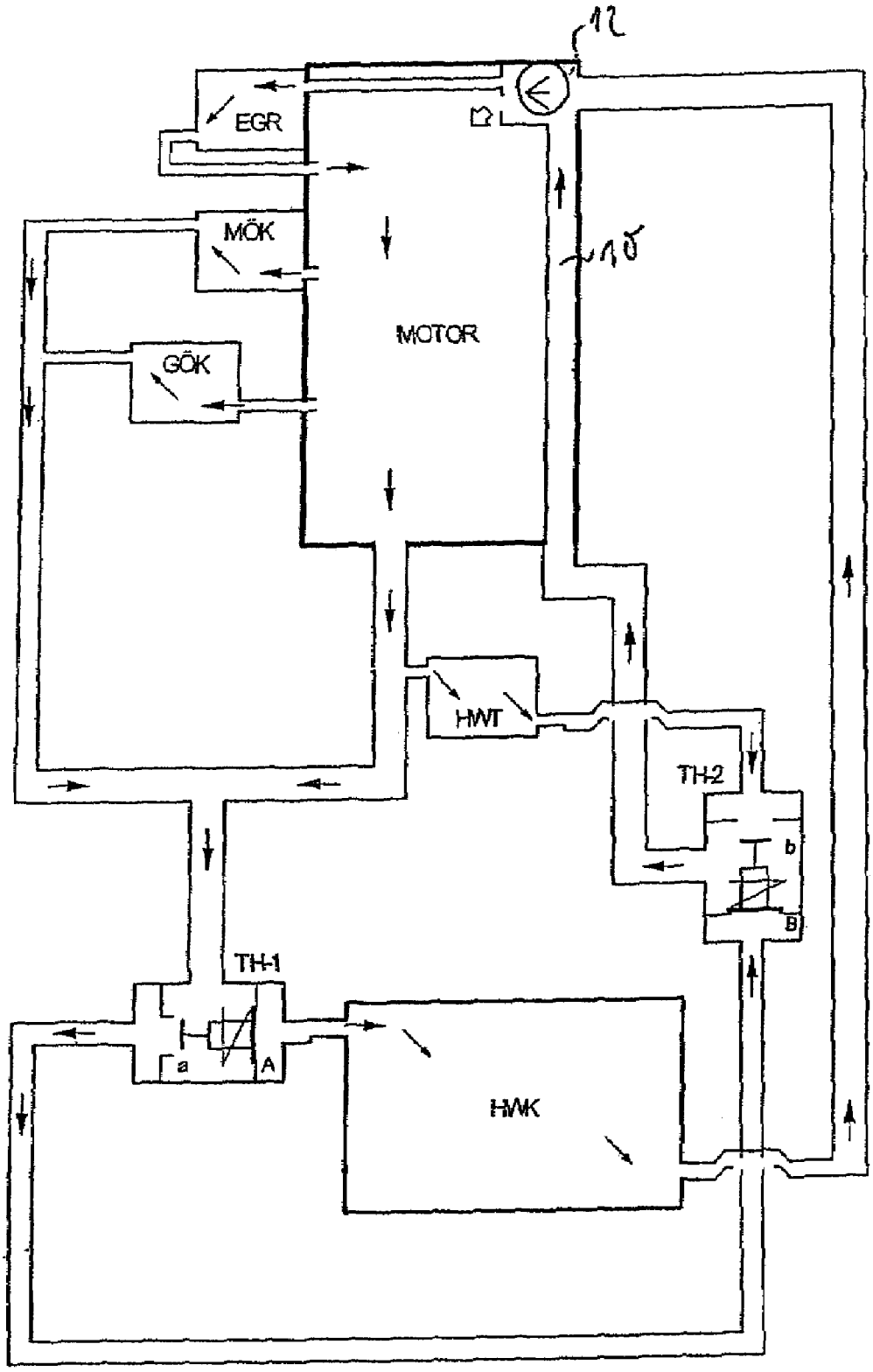

In the embodiment according to FIG. 4, an engine outlet control is provided again. The difference to FIG. 3 is that in the cold start the cooling water streams of the oil coolers MÖK and GÖK flow via the heat exchanger for heating HWT in the small circuit. From the opening temperature of the second thermostat TH2 on, there is offered a second path of this cooling fluid stream via the first thermostat TH1 and the thermostat valve B of the second thermostat. In the regular operation, i.e. when the first thermostat TH1 is opened, the cooling fluid is partly led through the bypass 10 and through the main water cooler HWK in the mixed operation mode.

Figure 5:
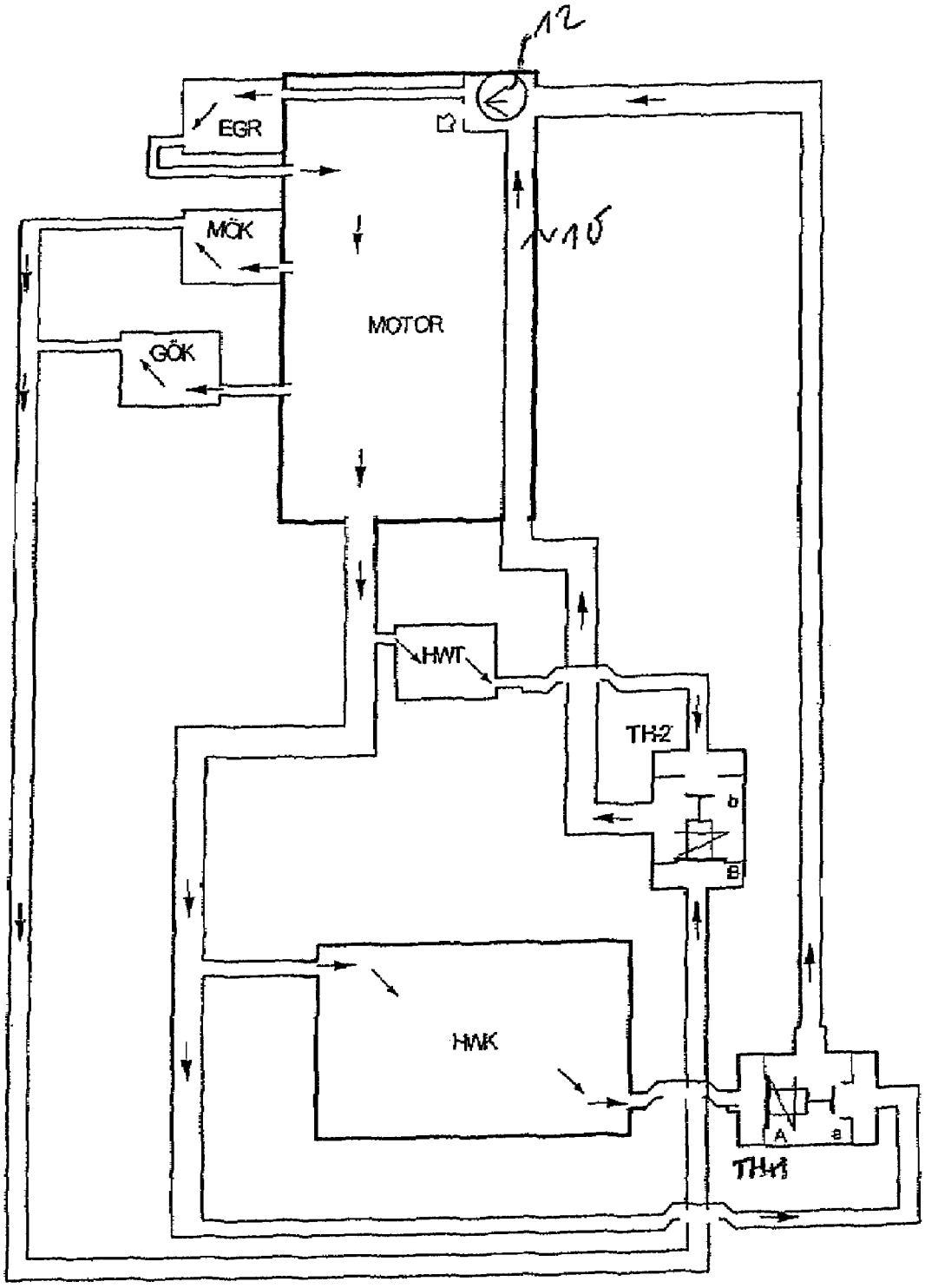

As emerges from the embodiment according to FIG. 5, the same permits the additional connection of the oil coolers MÖK and GÖK from the lower opening temperature of the second thermostat TH2 on. Up to this temperature, no cooling fluid is led through these heat exchangers.

The main water cooler HWK is connected via the first thermostat TH1. In this configuration, an additional stream of cooling fluid flows through the second valve a of the first thermostat TH1.

The invention claimed is:

1. A cooling system for a combustion engine having a cooling passage system in an engine block, said cooling system comprising:

a main cooler which is arranged in a cycle with the cooling passage system of the combustion engine, a pump and a first thermostat in said cycle, wherein said main cooler, said pump and said first thermostat are connected in series between an inlet of the cooling passage system and an outlet of the cooling passage system to define said cycle, a heat exchanger which is connected to the pump through a bypass passage, said bypass passage being outside said cycle, and a second thermostat in the bypass passage, wherein said heat exchanger, said pump and said second thermostat are connected in series between the inlet and outlet of the cooling passage system, a second opening temperature of a thermostat valve of the second thermostat is lower than a first opening temperature of a thermostat valve of the first thermostat, the thermostats being connected, by an interconnection passage, in series between the inlet and outlet of the cooling passage system, wherein when the thermostat valves are closed at a cooling fluid temperature below the second opening temperature, a minimum amount of cooling fluid flows through the cooling passage system (i) through the heat exchanger and (ii) without any flow of the cooling fluid through the main cooler, when the thermostat valve of the second thermostat is opened and the thermostat valve of the first thermostat remains closed at a cooling fluid temperature between the first and second opening temperatures, a larger amount of cooling fluid flows through the cooling passage system (i) via both the heat exchanger and the interconnection passage between the first and second thermostats, and (ii) without any flow of the cooling fluid though the main cooler, at a cooling fluid temperature at or above the first opening temperature, the thermostat valve of the first thermostat is opened to allow the cooling fluid to flow though the cooling passage system via the first thermostat and the main cooler.

2. The cooling system of claim 1, wherein from the second opening temperature, the thermostat valve of the second thermostat gradually opens as the cooling fluid temperature increases, the thermostat valve of the second thermostat arriving at a complete opening thereof at a cooling fluid temperature below the first opening temperature of the thermostat valve of the first thermostat.

3. The cooling system of claim 1, wherein each of the thermostat valves actuates a second valve which opens when the respective thermostat valve is closed and reduces an effective area thereof as an opening of the respective thermostat valve increases.

4. The cooling system of claim 3, wherein the second valve of the thermostat valve of the first thermostat is completely closed when the thermostat valve of the first thermostat is completely opened.

5. The cooling system of claim 4, wherein the second valve of the thermostat valve of the second thermostat is in a maximum throttling position but is not completely closed when the thermostat valve of the second thermostat is completely opened.

6. The cooling system of claim 3, wherein the second valve of the thermostat valve of the second thermostat is never completely closed regardless of the cooling fluid temperature.

7. The cooling system of claim 3, wherein the second valve of the thermostat valve of the first thermostat is connected with the thermostat valve of the second thermostat via said interconnection passage.

8. The cooling system of claim 7, wherein the second valve of the thermostat valve of the first thermostat is completely closed to completely close said interconnection passage when the thermostat valve of the first thermostat is completely opened.

9. The cooling system of claim 1, wherein the bypass passage is formed by a passage in the engine block.

10. The cooling system of claim 1, wherein the second opening temperature of the second thermostat is between 30 and 35° C.

11. The cooling system of claim 1, wherein from the second opening temperature, the amount of cooling fluid flowing through the cooling passage system is progressively increased as the cooling fluid temperature increases.

12. A cooling system for a combustion engine having a cooling passage system in an engine block, said cooling system comprising:

a main cooler which is arranged in a cycle with the cooling passage system of the combustion engine, a pump and a first thermostat in said cycle, wherein said main cooler, said pump and said first thermostat are connected in series between an inlet of the cooling passage system and an outlet of the cooling passage system to define said cycle, a heat exchanger which is connected to the pump through a bypass passage, said bypass passage being outside said cycle, and a second thermostat in the bypass passage, wherein said heat exchanger, said pump and said second thermostat are connected in series between the inlet and outlet of the cooling passage system, a second opening temperature of a thermostat valve of the second thermostat is lower than a first opening temperature of a thermostat valve of the first thermostat, wherein each of the thermostats further comprises a second valve jointly shifted with the respective thermostat valve in accordance with a cooling fluid temperature, said second valve being opened when the respective thermostat valve is closed and reduces an effective area thereof as an opening of the respective thermostat valve increases; and the second valve of the first thermostat is connected with the thermostat valve of the second thermostat via an interconnection passage.

13. The cooling system of claim 12, wherein the second valve of the first thermostat is closed when the thermostat valve of the first thermostat is completely opened at a cooling fluid temperature higher than the first opening temperature.

14. The cooling system of claim 13, wherein the second valve of the second thermostat is in a maximum throttling position but is not completely closed when the thermostat valve of the second thermostat is completely opened.

15. The cooling system of claim 12, wherein the second valve of the second thermostat is never completely closed regardless of the cooling fluid temperature.

16. The cooling system of claim 12, wherein the interconnection passage is completely closed either when the second valve of the first thermostat is closed and the thermostat valve of the first thermostat is completely opened at a cooling fluid temperature higher than the first opening temperature, or when the thermostat valve of the second thermostat is completely closed at a cooling fluid temperature lower than the second opening temperature.

* * * * *